US008025609B2

(12) United States Patent
Giannelli et al.

(10) Patent No.: US 8,025,609 B2
(45) Date of Patent: Sep. 27, 2011

(54) CROSS TRAINER EXERCISE APPARATUS

(75) Inventors: Raymond Giannelli, Franklin, MA (US); Scott Lee, Pomfret, CT (US)

(73) Assignee: Cybex International, Inc., Medway, MA (US)

( * ) Notice: Subject to any disclaimer, the term of this patent is extended or adjusted under 35 U.S.C. 154(b) by 790 days.

(21) Appl. No.: 10/806,833

(22) Filed: Mar. 22, 2004

(65) Prior Publication Data

US 2004/0224825 A1 Nov. 11, 2004

Related U.S. Application Data

(63) Continuation-in-part of application No. 10/294,017, filed on Nov. 13, 2002, now abandoned.

(60) Provisional application No. 60/337,498, filed on Nov. 13, 2001, provisional application No. 60/534,904, filed on Jan. 8, 2004.

(51) Int. Cl.
*A63B 22/00* (2006.01)

(52) U.S. Cl. ..... 482/51; 482/52

(58) Field of Classification Search ..... 482/51–53, 482/57, 70, 71, 79, 80; 601/23, 27, 33–35
See application file for complete search history.

(56) References Cited

U.S. PATENT DOCUMENTS

| | | | | |
|---|---|---|---|---|
| 326,247 | A * | 9/1885 | Root | 482/56 |
| 1,990,124 | A | 2/1935 | Kabisius | |
| 2,019,224 | A | 10/1935 | Hess | |
| 2,109,775 | A | 3/1938 | Hudson | |
| 3,756,595 | A | 9/1973 | Hague | |
| 3,791,646 | A | 2/1974 | Marchignoni | |
| 4,861,023 | A | 8/1989 | Wedman | |
| 5,004,224 | A * | 4/1991 | Wang | 482/53 |
| 5,039,088 | A * | 8/1991 | Shifferaw | 482/51 |
| 5,242,343 | A | 9/1993 | Miller | |
| 5,279,529 | A | 1/1994 | Eschenbach | |
| 5,383,829 | A | 1/1995 | Miller | |
| 5,391,130 | A | 2/1995 | Green | |
| 5,496,235 | A * | 3/1996 | Stevens | 482/51 |
| 5,562,574 | A | 10/1996 | Miller | |

(Continued)

FOREIGN PATENT DOCUMENTS

CA 2 407 758 A1 11/2004

(Continued)

OTHER PUBLICATIONS

Dr. Theodor Büdingen in Konstanz "Bewegungsapparat für Bettlägerige, insbesondere Herzkranke" Oct. 20, 1908.

(Continued)

*Primary Examiner* — Loan Thanh
*Assistant Examiner* — Tam Nguyen
(74) *Attorney, Agent, or Firm* — Rissman Hendricks & Oliverio, LLP

(57) ABSTRACT

Apparatus and method for simulating a back and forth leg or foot movement, the apparatus comprising: a pair of pivotable support mechanisms supported on a frame, a pair of foot pedals mounted on the support mechanisms for back and forth movement along an arcuate path of translation movement, the foot pedals being adjustable to a selected segment of an overall arcuate path of translation movement. The apparatus includes handles or arms interconnected or interlinked to the foot pedals for upper body pushing or pulling energy input. The handles or arms pivot together with and in the same back or forth direction as the pedals to which they are interlinked.

14 Claims, 9 Drawing Sheets

U.S. PATENT DOCUMENTS 5,584,781 A * 12/1996 Chen ..... 482/51
5,605,521 A * 2/1997 Hsieh ..... 482/51
5,643,153 A 7/1997 Nylen et al.
5,655,998 A * 8/1997 Yu ..... 482/51
5,681,244 A 10/1997 Hsieh
5,685,804 A 11/1997 Whan-Tong et al.
5,707,320 A 1/1998 Yu
5,720,698 A 2/1998 Dalebout et al.
5,788,610 A 8/1998 Eschenbach
5,792,027 A 8/1998 Gvoich
5,833,584 A 11/1998 Piaget et al.
5,857,940 A * 1/1999 Husted ..... 482/51
5,876,307 A 3/1999 Stearns et al.
5,879,271 A 3/1999 Stearns et al.
5,895,339 A 4/1999 Maresh
5,897,459 A 4/1999 Habing et al.
5,910,072 A 6/1999 Rawls et al.
5,913,751 A 6/1999 Eschenbach
5,916,064 A 6/1999 Eschenbach
5,921,894 A 7/1999 Eschenbach
5,957,814 A 9/1999 Eschenbach
5,993,359 A 11/1999 Eschenbach
6,004,244 A 12/1999 Simonson
6,022,296 A * 2/2000 Yu ..... 482/52
6,024,676 A 2/2000 Eschenbach
6,027,430 A 2/2000 Stearns et al.
6,036,622 A * 3/2000 Gordon ..... 482/51
6,042,512 A 3/2000 Eschenbach
6,045,488 A 4/2000 Eschenbach
6,053,847 A 4/2000 Stearns et al.
6,077,196 A 6/2000 Eschenbach
6,077,198 A 6/2000 Eschenbach
6,090,013 A 7/2000 Eschenbach
6,090,014 A 7/2000 Eschenbach
6,126,573 A 10/2000 Eschenbach
6,135,926 A 10/2000 Lee
6,142,915 A 11/2000 Eschenbach
6,168,552 B1 1/2001 Eschenbach
6,210,305 B1 4/2001 Eschenbach
6,217,485 B1 4/2001 Maresh
6,248,044 B1 6/2001 Stearns et al.
6,277,054 B1 8/2001 Kuo
D450,101 S 11/2001 Hsu
6,361,476 B1 3/2002 Eschenbach
6,551,218 B2 4/2003 Goy
6,648,801 B2 11/2003 Stearns et al.
6,761,665 B2 * 7/2004 Nguyen ..... 482/51
2003/0092532 A1 5/2003 Giannelli et al.
2004/0224825 A1 11/2004 Giannelli et al.

FOREIGN PATENT DOCUMENTS

CH 673092 A5 2/1990
DE 229712 10/1923
FR 498.150 12/1919
WO WO 96/08292 3/1996
WO WO 95/00209 1/1999

OTHER PUBLICATIONS

M. Pierre-Joseph Amieux, rèsident en France (Hautes-Alpes) "Appareil mècanothèrapique destine á la mobilisation passive des membres infèrieurs des blessès ou malades alitès" Jun. 6, 1916.

* cited by examiner

CROSS TRAINER EXERCISE APPARATUS

RELATED APPLICATIONS

This application claims the benefit of priority under 35 USC Section 119 to U.S. provisional patent application Ser. No. 60/534,904 filed Jan. 8, 2004, the disclosure of which is incorporated herein by reference in its entirety as if fully set forth herein. This application is also a continuation in part of and claims the benefit of priority under 35 U.S.C. Sections 119 and 120 to U.S. patent application Ser. No. 10/294,017 filed Nov. 13, 2002 now abandoned which claims priority to Provisional application No. 60/337,498 filed Nov. 13, 2001. The disclosures of all of the foregoing applications are incorporated by reference herein in their entirety as if fully set forth herein.

FIELD OF THE INVENTION

The present invention relates to physical exercise machines and more particularly to an exercise apparatus that enables users to perform a simulated walking, running or other back and forth leg movement exercise.

BACKGROUND OF THE INVENTION

Exercise machines for simulating walking or running are known and used for directing the movement of a user's legs and feet in a variety of repetitive paths of travel. Machines commonly referred to as elliptical path machines have been designed to pivot the foot pedals on which the user's feet reside causing the pedals and the user's feet to travel in an elliptical or arcuate path. The angular degree of pivoting of the foot pedals in such elliptical or arcuate machines changes as the foot pedal travels from back to front and front to back along the path of travel or translation of the user's foot, by typically more than about 3 degrees and more typically more than 10-30 degrees. The path of travel of the foot pedal in such machines is not adjustable other than to change the shape of the ellipse. The foot travels along a different path from back to front than from front to back in such elliptical machines. There is no provision in such prior apparati for incorporating upper body exercise. There is no provision of a handle or hand grip that is interconnected to a foot pedal which together move/pivot simultaneously in the same back or forth direction.

SUMMARY OF THE INVENTION

In accordance with the invention there is provided an apparatus for simulating a back and forth leg movement, the apparatus comprising:

a pair of pivotable support mechanisms supported on a frame, a pair of foot pedals mounted on the support mechanism for back and forth movement along an arcuate path of translation movement, wherein the pedals have a generally planar foot sole receiving surface and wherein the foot pedals are pivotably mounted in an arrangement on the support mechanisms such that the sole receiving surfaces of the foot pedals pivot or rotate less than about three degrees during the back and forth movement of the support mechanisms and preferably less than about 2.5 degrees.

The foot pedals are preferably mounted in an arrangement on the support mechanisms such that the sole receiving surfaces remain generally coplanar with a fixed reference plane during the back and forth movement of the support mechanisms.

The support mechanisms preferably comprise a pair of four bar linkage mechanisms that each have opposing back and front link lengths that are substantially equal to each other and opposing upper and lower link widths that are substantially equal to each other. The foot pedals comprise or are otherwise mounted on the lower link of each four bar linkage.

There is also provided an apparatus for simulating a back and forth leg or foot movement, the apparatus comprising:

a pair of pivotable support mechanisms supported on a frame, a pair of foot pedals mounted on the support mechanisms for back and forth movement along an arcuate path of translation movement, wherein the pedals have a generally planar foot sole receiving surface and wherein the foot pedals are pivotably mounted in an arrangement on the support mechanisms such that the sole receiving surfaces of the foot pedals pivot or rotate less than about three degrees during the back and forth movement of the support mechanisms. The foot pedals are mounted in an arrangement on the support mechanisms such that the sole receiving surfaces remain generally coplanar with a fixed reference plane during the back and forth movement of the support mechanisms.

Further in accordance with the invention there is provided, an apparatus for simulating a back and forth leg or foot movement comprising:

a pair of foot pedals each having a foot sole receiving surface, the foot pedals being mounted on a frame for movement in a back and forth direction along an arcuate path between forwardmost and rearwardmost positions; a pair of manually graspable input arms and/or handles each pivotably interconnected to a respective one of the foot pedals for pivoting movement in the same back or forth direction as an interconnected foot pedal moves; wherein pushing or pulling of an arm and/or handle by a user in the back or forth direction inputs force or energy to movement of a pedal interconnected to an arm and/or handle.

There is further provided an apparatus for simulating a back and forth leg or foot movement comprising a pair of left and right foot pedals each having a foot sole receiving surface, the foot pedals being mounted on a frame for movement in a back and forth direction along an arcuate path between forwardmost and rearwardmost positions;

a pair of left and right handles for being grasped by a user's hands each pivotably interconnected to a respective one of the left and right foot pedals such the left handle pivots forwardly together with forward movement of the left pedal, the left handle pivots backwardly together with backward movement of the left pedal, the right handle pivots forwardly together with forward movement of the right pedal and the right handle pivots backwardly together with backward movement of the right pedal.

In another aspect of the invention there is provided an apparatus for simulating a back and forth leg or foot movement comprising:

a pair of left and right foot pedals each having a foot sole receiving surface, the foot pedals being mounted on a frame for movement in a back and forth direction along an arcuate path between forwardmost and rearwardmost positions;

a pair of left and right manually graspable input arms and/or handles each pivotably interconnected to a respective one of the left and right foot pedals such that the left arm and/or handle pivots forwardly together with forward movement of the left pedal, the left arm and/or handle pivots rearwardly together with backward movement of the left pedal, the right arm and/or handle pivots forwardly together with forward movement of the right pedal and the right arm and/or handle pivots rearwardly together with backward movement of the right pedal. The foot pedals are preferably adjustable to move in an arcuate path of selected incline.

The handles and/or the input arms are preferably adjustable to move in a pivot path of selected degree of pivot.

Most preferably, the pedals and the handles and/or input arms are interconnected to a pivot mechanism adjustable to a selected degree of pivot that adjusts the arcuate path of the foot pedals and the degree of pivot of the input arms and/or handles.

The handles and/or the input arms and the pedals are interconnected to a reciprocating mechanism that directs one of the left or right pedals to travel in the back or forth direction while simultaneously directing the other of the left or right pedals to travel in an opposite direction.

The reciprocating mechanism typically comprises a rotating mechanism having a pair of pivot points, one pivot point pivotably interconnected to one of the left or right pedals and arms and/or handles and the other pivot point pivotably interconnected to the other of the left or right pedals and handles or arms.

The pivot points are typically disposed at substantially opposing 180 degree positions along a circular path of rotation, the pedals and the handles or arms being interconnected to a respective pivot point by a link mechanism.

In another aspect of the invention there is provided, an apparatus for simulating a back and forth leg or foot movement comprising:

a pair of left and right foot pedals each having a foot sole receiving surface, the foot pedals being mounted on a frame by linkages for movement in a back and forth direction along an overall arcuate path defined by the linkages;

a pair of left and right manually graspable input arms or handles each pivotably interconnected to a respective one of the left and right foot pedals for pivoting movement in the back or forth direction;

wherein the foot pedals are adjustable to move along a selected segment of the overall arcuate path between forwardmost and backwardmost positions, the selected segment of the overall arcuate path being variably selectable by the user to have a variable degree of incline.

Preferably the left arm or handle pivots forwardly together with the forward movement of the left pedal, the left arm and/or handle pivots rearwardly together with backward movement of the left pedal, the right arm and/or handle pivots forwardly together with forward movement of the right pedal and the right arm and/or handle pivots rearwardly together with backward movement of the right pedal.

Further in accordance with the invention there is provided, an apparatus for simulating a back and forth leg or foot movement comprising:

a pair of foot pedals each having a foot sole receiving surface, the foot pedals being mounted on a frame for movement in a back and forth direction along an arcuate path between forwardmost and rearwardmost positions;

a pair of manually graspable input handles or arms each pivotably interconnected to a respective one of the foot pedals for pivoting movement in the back or forth direction;

wherein the handles or arms and the pedals are interconnected to a control mechanism that directs one interconnected arm and/or handle and pedal to travel in the back or forth direction while simultaneously directing the other interconnected arm and/or handle and pedal to travel in an opposite direction.

Further in accordance with the invention there is provided, an apparatus for simulating a back and forth leg or foot movement, the apparatus comprising:

a pair of left and right four bar linkage support mechanisms supported on a frame for back and forth pivoting movement, each four bar linkage mechanism comprising a pair of opposing forward and rearward pivot links each having a length and a pair of opposing upper and lower pivot links each having a width;

wherein the lower pivot link of each four bar linkage mechanism comprises a foot pedal for back and forth movement along an arcuate path of translation movement, wherein the lengths of the forward and rearward links are substantially equal to each other and the widths of the upper and lower pivot links are substantially equal to each other.

In another aspect of the invention there is provided a, method for performing a back and forth leg, foot and upper body exercise by a subject on an exercise apparatus, the method comprising:

positioning the soles of the feet of a subject on a pair of left and right foot pedals adapted to be moved in a back and forth motion along arcuate paths of translation;

the left and right foot pedals being respectively interconnected to left and right manually graspable handles, each handle being adapted to pivot forwardly together with forward movement of its respectively interconnected foot pedal and to pivot backwardly together with backward movement of its respectively interconnected foot pedal;

wherein the subject positions a right or left foot on a respective one of the right or left pedals; and wherein the subject exerts sufficient energy to move a respective one of the left or right pedals forwardly or backwardly and to simultaneously pivot a respective one of the left or right handles forwardly or backwardly.

Preferably, the subject selects the degree of incline, of the arcuate paths of translation of the foot pedals.

There is also provided, a method for performing a back and forth leg, foot and upper body exercise by a subject on an exercise apparatus, the method comprising:

positioning the soles of the feet of a subject on a pair of left and right foot pedals adapted to be moved in a back and forth motion along arcuate paths of translation;

the left and right foot pedals being respectively interconnected to left and right manually graspable arms and/or handles, each arm and/or handle being adapted to pivot forwardly together with forward movement of a respectively interconnected foot pedal and to pivot backwardly together with backward movement of its respectively interconnected foot pedal;

wherein the subject positions a right or left foot on a respective one of the right or left pedals; and wherein the subject exerts sufficient energy with a respective one of the subject's left or right arms or hands to push or pull a respective one of the left or right arms and/or handles forwardly or backwardly and to simultaneously move a respective one of the left or right pedals forwardly or backwardly.

In another aspect of the invention there is provided, a method for performing a back and forth leg, foot and upper body exercise by a subject on an exercise apparatus, the method comprising:

positioning the soles of the feet of a subject on a pair of foot pedals adapted to be moved in a back and forth motion along arcuate paths of translation;

the foot pedals being interconnected to a frame of the apparatus such that the foot pedals rotate or pivot less than about 3 degrees during movement in the back and forth motion;

wherein the subject exerts energy to move one of a left or right foot forward while standing on one pedal and simultaneously exerts energy to move the other of the left or right foot backwardly while standing on the other pedal.

BRIEF DESCRIPTION OF THE DRAWINGS

The above and further advantages of the invention may be better understood by referring to the following description in conjunction with the accompanying drawings in which.

DETAILED DESCRIPTION

Generally, the present invention is an exercise apparatus that provides a low impact workout yet offers the potential for an intensive cardiovascular workout by eliminating the unnatural motion and awkward foot alignments typical of many stair-climbing and elliptical training devices. The invention provides one or more foot supports movable along an arcuate path and defined around a point of rotation. The arcuate path is divisible into machine defined, user selectable arc segments. The exercise apparatus includes a frame, a frame linkage movably engaged with the frame, one or more foot supports movably engaged with the frame linkage, a crank movably engaged with the frame, a motor operative to move the crank location with respect to the frame, and a drive linkage movably engaging the frame linkage.

Figure 1:
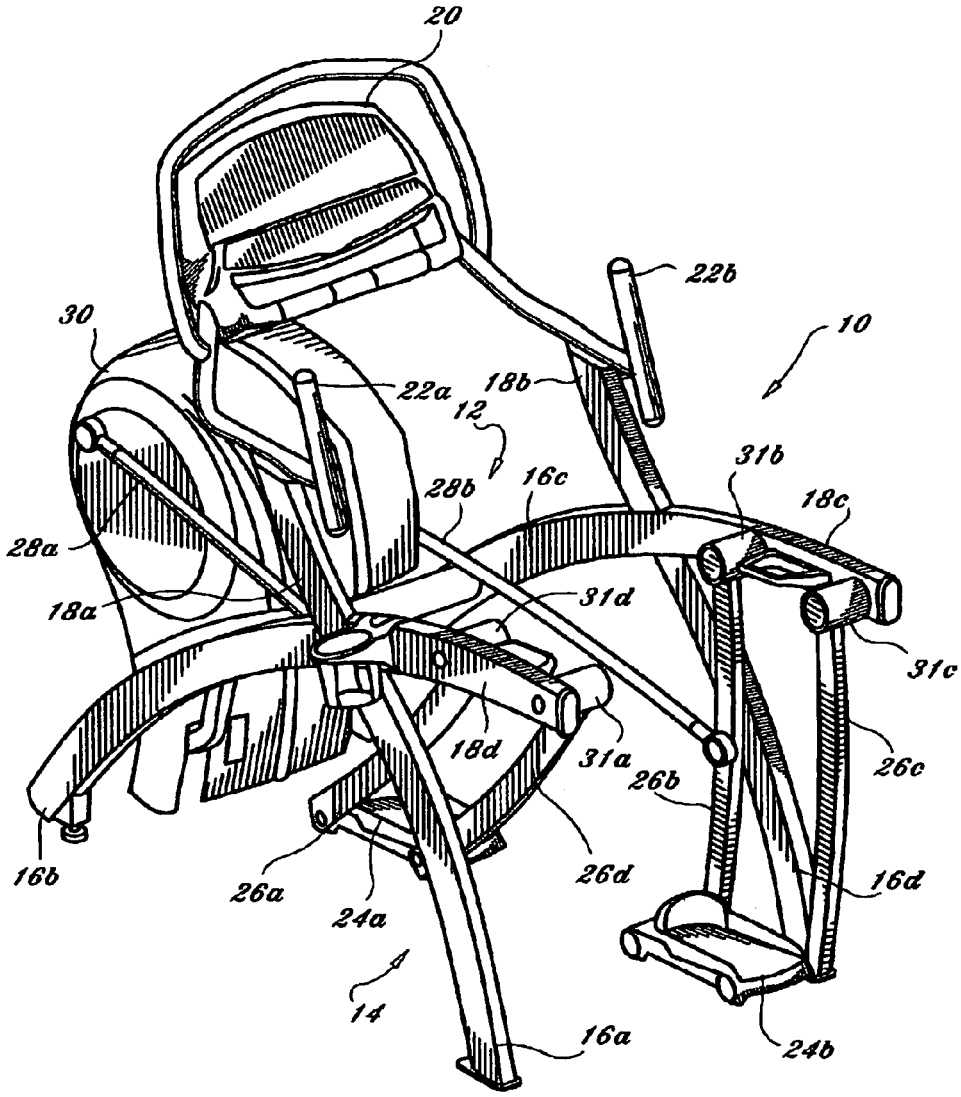
FIG. 1 is a rear perspective view of a device in accordance with the invention.

FIG. 1 is a perspective view of an exercise device in accordance with the present invention. The device includes a frame 10 having a front region 12, a rear region 14, "legs" 16*a*, 16*b*, 16*c* and 16*d*, and upper supports 18*a*, 18*b*, 18*c*, and 18*d*. Upper supports 18*c* and 18*d* comprise the upper links of a pair of four bar linkages and part of the arcuate portion of the frame, terminate in legs 16*c* and 16*b* respectively and are an integral part of frame 10. A display/control panel 20 and hand grips 22*a* and 22*b* are secured to the upper supports 18*a* and 18*b*.

Foot supports 24*a* and 24*b* are sized to receive the foot of a user. Foot supports 24*a* and 24*b* are movably connected to, and supported by, forward linkages or legs 26*a* and 26*b*, and rear linkages 26*c* and 26*d*. Linkages 26*a*-26*d* are movably connected to the rear region 14 of frame 10 by upper supports or links 18*d* and 18*c*. Although the device is shown with opposing pairs of linkages supporting each foot support, other embodiments are contemplated having fewer or more linkages supporting and controlling the range and path of motion of foot supports 24*a* and 24*b* associated with the linkage(s).

The foot supports 24*a* and 24*b* approximate a shod human foot in size and shape. They can include a non-skid surface and be bounded by one or more low lips to help a shoe remain in place on the foot supports during use. Alternately, straps may maintain each foot within the foot support to further retain the user's foot in place during use. However, as used herein, a "foot support" can also encompass any designated support such as a pedal, a pad, a toe clip, or other foot/toe/leg and device interface structure as is known in the art.

The forward linkages or legs 26*a* and 26*b* are movably connected to drive linkages 28*a* and 28*b*; and the drive linkages are in turn connected to other elements (illustrated in FIGS. 3 and 4 and described below) concealed by a housing 30. In other embodiments, the drive linkages 28*a* and 28*b* are connected directly to the foot supports 24*a* and 24*b*. Additionally, "foot supports" can be on or integral to either the forward linkages or to the one or more linkages joined to the frame.

As illustrated in FIG. 1, representative movable connectors 31*a*, 31*b*, 31*c*, and 31*d* include pivot assemblies, as known in the art, that provide very smooth and easy relative rotation or reciprocal motion by elements joined by the pivot assemblies. Movable connectors 31*b* and 31*d* rotatably couple forward linkages or legs 26*b* and 26*a*, respectively, to upper supports or links 18*c* and 18*d*. Movable connectors 31*c* and 31*a* rotatably couple rear linkages 26*c* and 26*d*, respectively, to upper supports or links 18*c* and 18*d*. Other connection assemblies that permit similar motion are contemplated by the invention. The movable connectors allow for a smooth and controlled swinging of foot supports 24*a* and 24*b* in an arcuate path.

Figure 2:
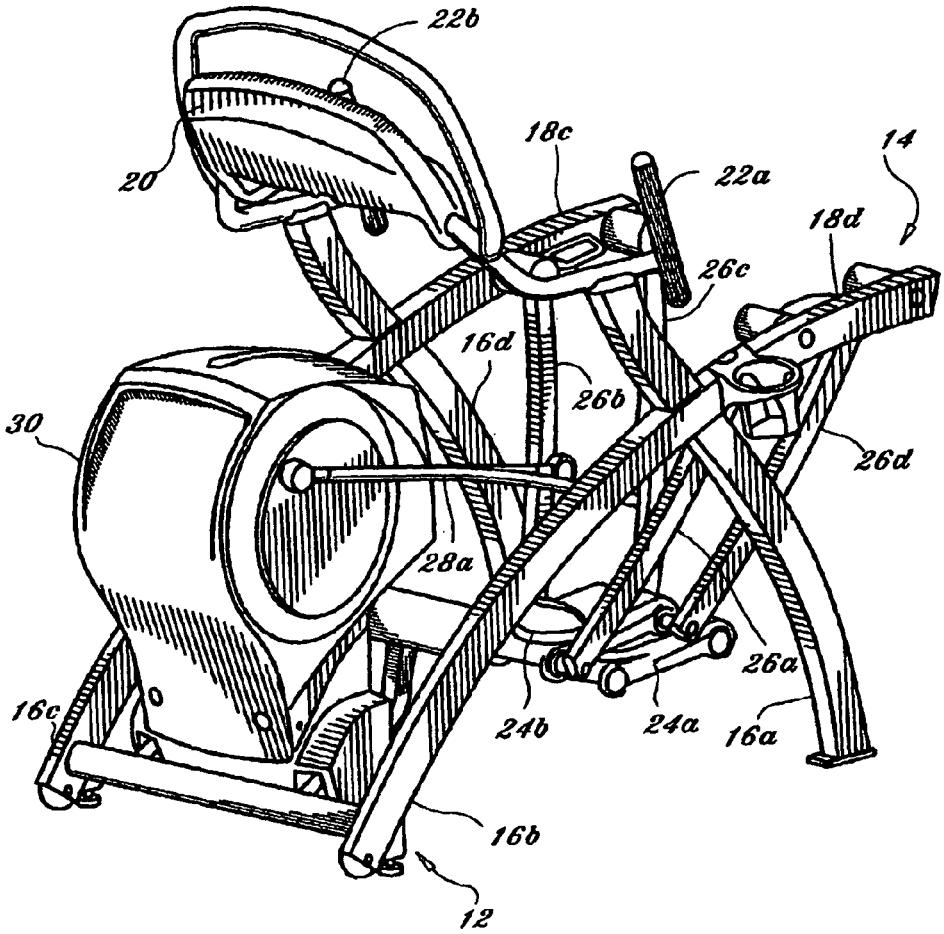
FIG. 2 is a front perspective view of the device of FIG. 1.

FIG. 2 is a front perspective view of the device shown in FIG. 1 illustrating the elements described above from a different angle. This illustration shows the device from the front region 12 perspective. Once again it can be seen that foot supports 24*a* and 24*b* are suspended from their respective linkages. Drive linkages 28*a* and 28*b* (not shown in FIG. 2) are coupled at their first ends to the substantial mid-point of front linkages or legs 26*a* and 26*b*, respectively. Drive linkages 28*a* and 28*b* are coupled at their second ends to a crank assembly (not shown) contained within housing 30, which contains the resistance assembly shown in FIG. 4 and described in greater detail below.

Figure 3:
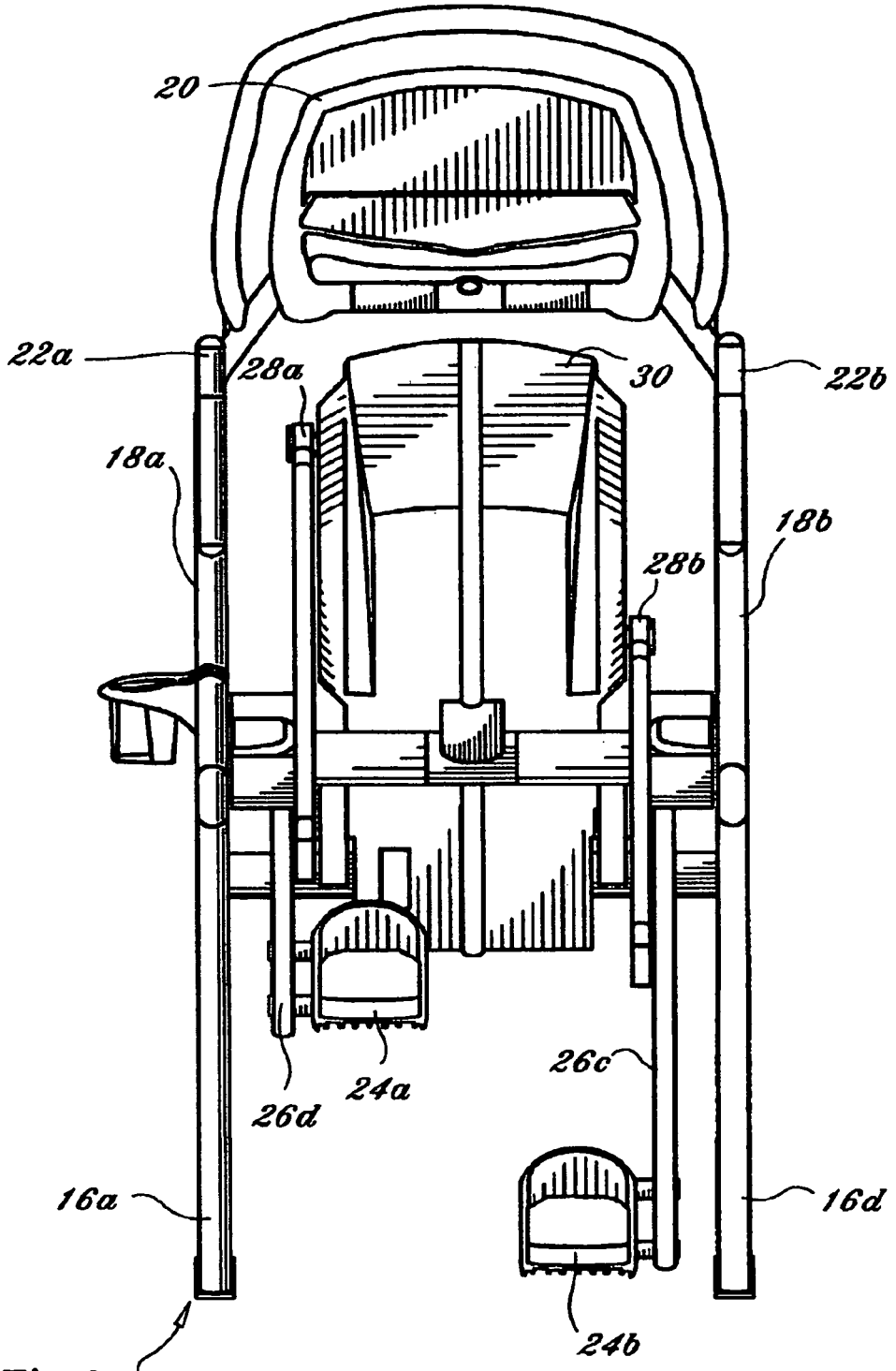
FIG. 3 is a rear view of the device of FIG. 1.

FIG. 3 is a rear view of the device of FIG. 1. The illustration in FIG. 3 is how a user would view the device upon mounting. Foot supports 24*a* and 24*b* are positioned to allow the user to place his or her feet on the pedals. As described above, clips or straps may be used to firmly secure the user's feet within their respective foot supports. Drive linkages 28*a* and 28*b* are coupled to either side of housing 30. Crankshaft 32 (shown in FIG. 4) projects from each side of housing 30 and is connected to each of the drive linkages via crank arms 40*a* and 40*b*. Handles 22*a* and 22*b* allow the user to steady themselves while the user's legs move in an arcuate path of motion.

Monitor 20 may include displays and controls to allow the user to manipulate the intensity of the resistance to create an easier or more difficult exercise routine and to adjust the motion path of the foot supports to one that is more inclined or less inclined.

Figure 4:
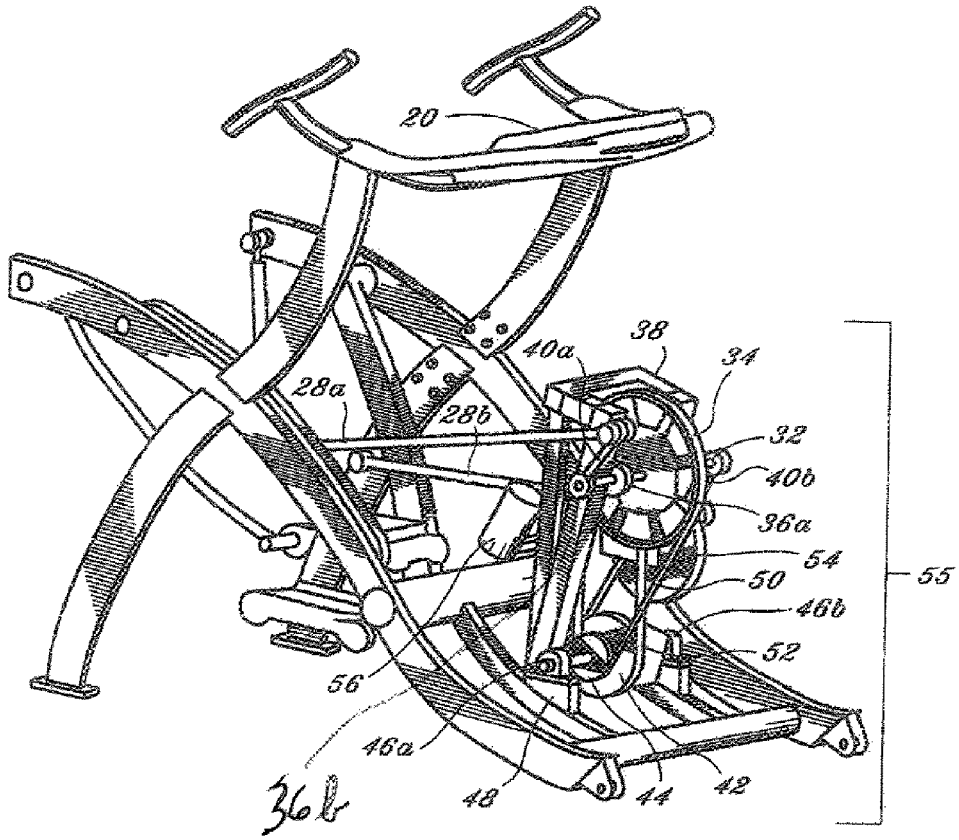
FIG. 4 is a front perspective view of the device of FIG. 1, shown with a housing for moving parts removed.

In FIG. 4, where an alternate embodiment of the present invention is shown, housing 30 is not shown so that additional internal elements of resistance assembly 55 therein can be revealed. For example, the forward ends of drive linkages 28*a* and 28*b* are shown attached to crank arms 40*a* and 40*b*, which are connected to a crankshaft 32 that turns a pulley 34 in communication with other elements described, below.

FIG. 4 illustrates the pulley 34 mounted on the crankshaft 32. Top bearings 36*a* and 36*b* receiving the crankshaft 32 are secured to a mounting 38. Crank arms 40*a* and 40*b* are secured to each end of the crankshaft 32 and are movably coupled to the drive linkages 28*a* and 28*b*, respectively, as is known in the art. A second pulley 42, rotatably mounted on stationary shaft 44, which is mounted to frame member 38, is coupled to the pulley 34 with a belt 50. A second belt 52 couples the second pulley 42 to a brake/flywheel assembly 54, which includes a rotatable mass such as a flywheel 54*a* secured to the mounting 38.

As shown in FIG. 4, the mounting 38 pivots around bottom bearings 46*a* and 46*b* so as to be rotatable fore and aft. A motor 56 or supplemental motor (not shown), responsive to input from the display/control panel 20, acts as a tilt actuator to tilt the mounting 38 and the elements affixed thereto. As shown, the pulley 34, the second pulley 42 and the resistance assembly 55 including a flywheel 54*a* rotate about an axis that is orthogonal to the longitudinal axis of the frame 10. It should be clear from the above description of the drive system that both pedals 24*a* and 24*b* are synchronized together by the motion of crankshaft 32. It should also be noted that there are no clutches between crankshaft 32 and brake/flywheel assembly 54. This is done to allow the inertia of brake/flywheel assembly 54 within resistance assembly 55 to assist the pedals 24*a* and 24*b* through the weaker portion of the range of motion of the users leg.

Although the brake/flywheel assembly 54 is the preferred component in resistance assembly 55, various other braking devices such as known to those skilled in the art can be associated with the rotatable elements to inhibit rotation thereof. The braking device may include but is not limited to any of the following: friction and air resistance devices such as fans, pneumatic or hydraulic devices, as well as various other types of electromechanical braking devices. This list is by no means exhaustive and represents only a few examples of resistance mechanisms that may be incorporated into the present invention. The configuration disclosed herein, i.e. use of a flywheel, is especially desirable because it promotes a very smooth, bilateral, reciprocal motion that is easily maintained by a device user.

Figure 5:
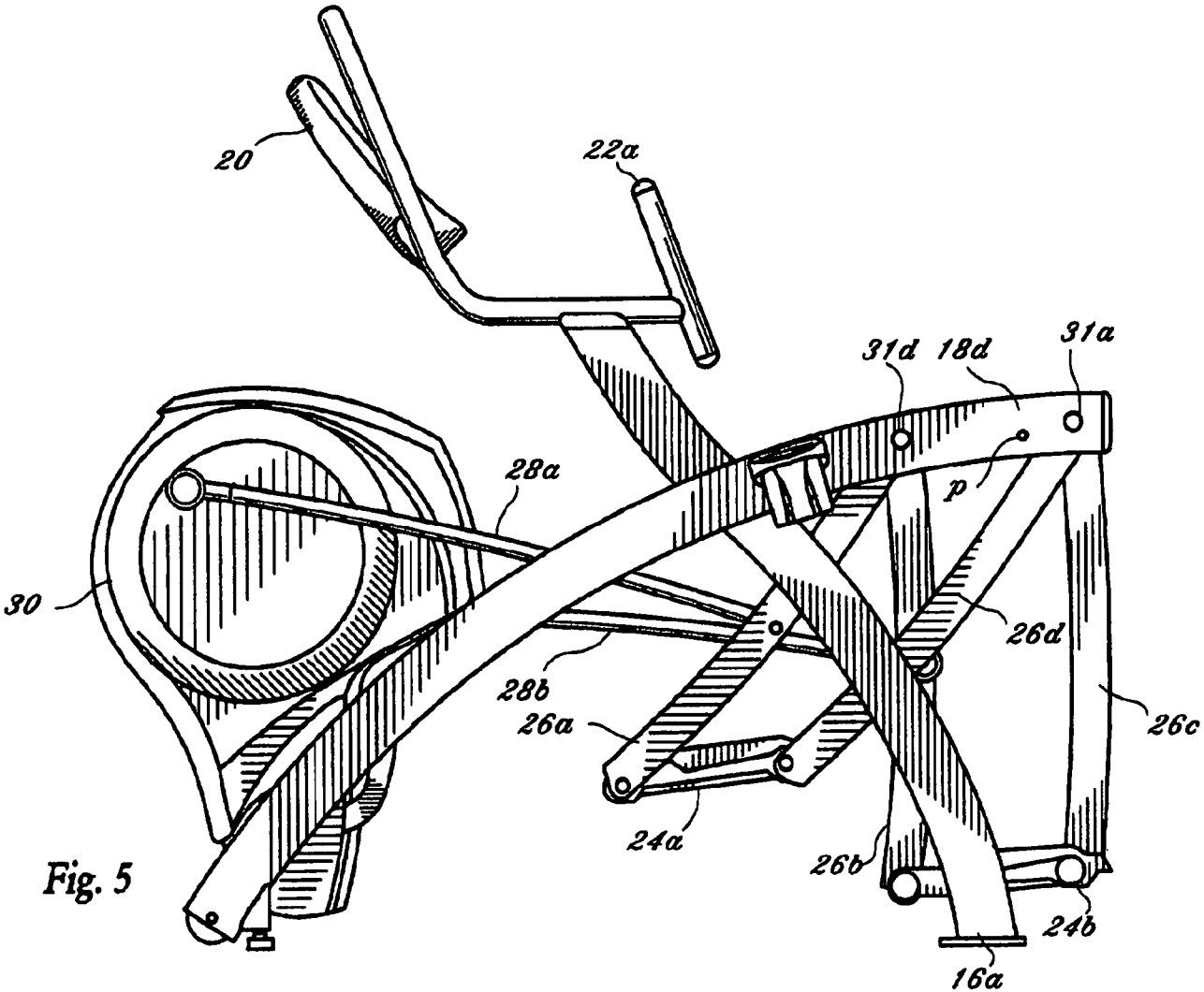
FIG. 5 is a side view of the device of FIG. 1.

FIG. 5 is a side view of the device. In this view, the foot supports 24*a* and 24*b*, forward linkages or legs 26*a*, 26*b* and rear linkages or legs 26*c*, 26*d* are presented from a perspective that allows ready visualization of the path that foot supports 24*a* and 24*b*, and thus a user's feet, will traverse as the foot supports move fore and aft while suspended from the forward and rear linkages. It will be noted that as foot supports 24*a* and 24*b* move fore and aft, the forward and aft limit of motion is not unbounded. Rather, the range of motion is defined by the length of the crank arms 40*a* and 40*b* (shown in FIG. 4), which provide an appropriate stride length. Further, because the foot supports 24*a* and 24*b* are pivotally connected to, and swing with, the forward linkages 26*a*, 26*b* and rear linkages 26*c*, 26*d*, the foot supports travel a curved or arcuate path, and not an elliptical path, to provide more favorable biomechanics.

The motion path for the foot supports 24*a* and 24*b* can also be altered by adjusting the position of mounting 38. As described above, the mounting 38 is pivotally mounted to the frame member 48 and pivots fore and aft upon command. As is evident by reference to the Figures, pivoting the mounting 38 forward moves the components secured directly or indirectly thereto forward. Likewise, pivoting the mounting 38 rearward causes the components secured directly or indirectly thereto to move rearward. This repositioning causes the motion path of the foot supports 24*a* and 24*b* to move to a different location along an arcuate path around a point of rotation "p", shown here between pivot assemblies 31*b* and 31*c*, at a distance established by the length of the forward and rear linkages or legs 26*a*, 26*b*, 26*c* and 26*d*. Thus, the specific location on the arc or arc segment ("the motion path") is user selectable to increase or decrease stride angle and location from a number of user selectable points, or arc segments, defined around the point of rotation.

In operation, a user approaches the device from the rear region 14, grasps the hand grips 22*a* and 22*b*, and places a foot on each of the foot supports 24*a* and 24*b*. The user's feet and legs begin to move fore and aft in a comfortable stride. The user selects an exercise program or manually adjusts the device by imputing commands via the display/control panel 20. In response to the command input, the resistance to fore and aft movement of the foot supports 24*a* and 24*b* can be altered by impeding rotation of the pulleys 34, 42 or the flywheel. Also, in response to command, input, the mounting 38 is moved fore or aft. As shown, when the mounting 38 moves' forward, the motion path of the foot supports is on a more inclined or vertical define arc segment. To discontinue use of the device, a user simply stops striding, thereby causing the movement of the device to stop, and dismounts from the foot supports.

Figure 5A:
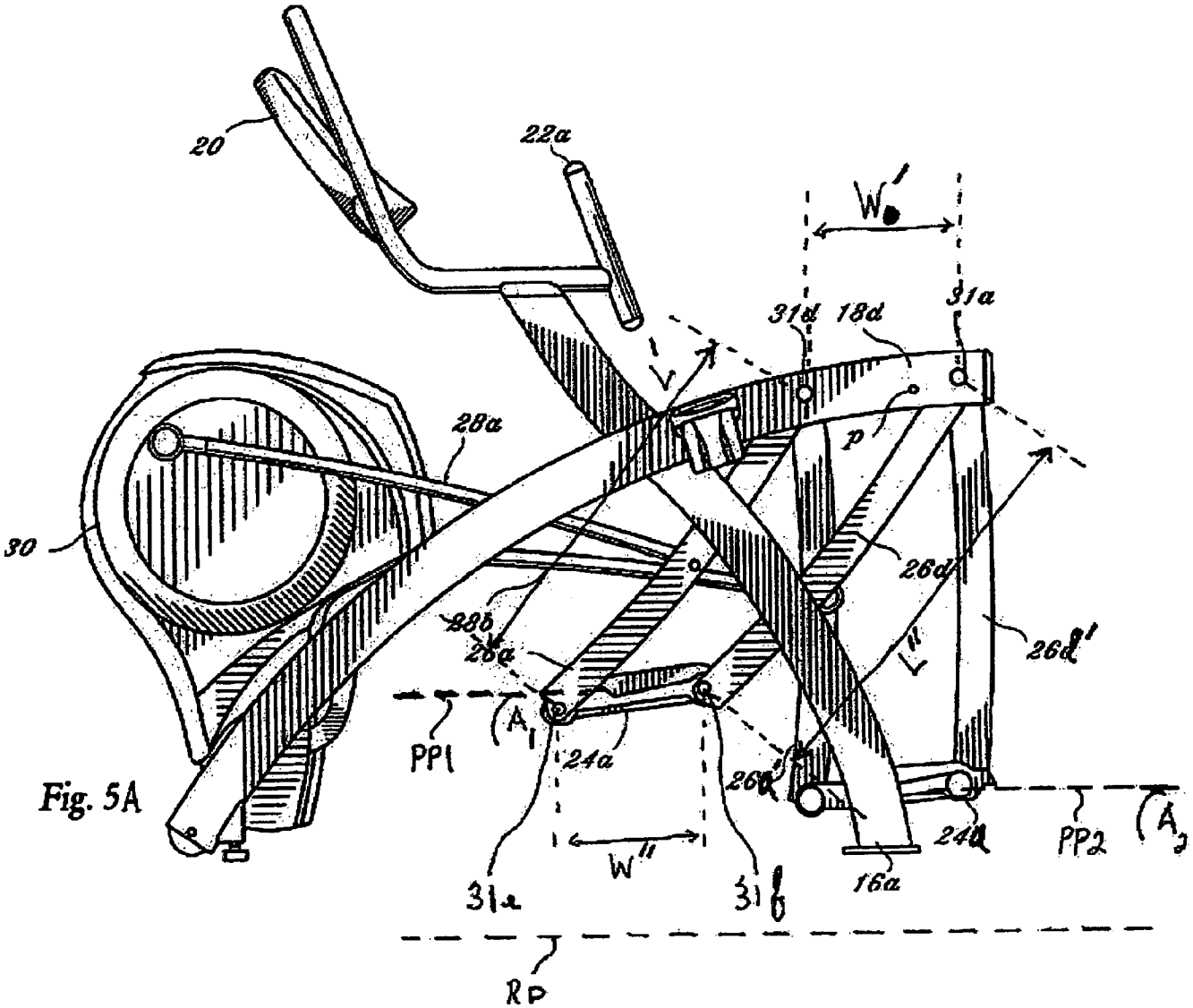
FIG. 5A is a side view of the FIG. 1 apparatus showing an embodiment, where the foot pedal is essentially non-rotating between the forward and backward positions.
Figure 6:
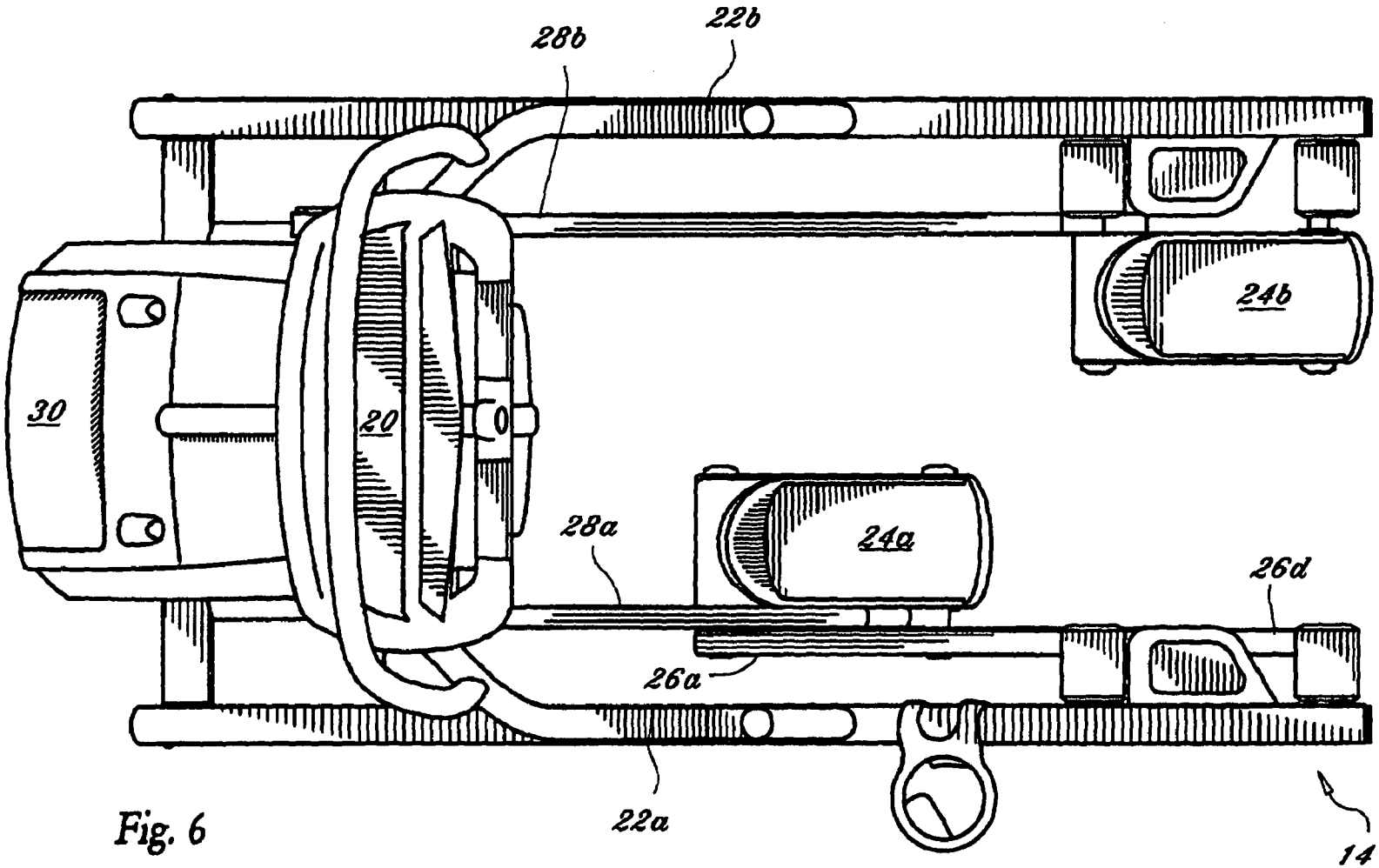
FIG. 6 is a top view of the device in FIG. 1.

FIG. 5A illustrates another embodiment of the invention showing one of the four bar linkage support mechanisms in a rearward 26*a*', 26*d*' and a forward 26*a*, 26*d* position along the pivot stroke of the four bar linkage. The four bar linkage has opposing pivot widths (or opposing pivot link, 18*c*/24*b*, 18*d*/24*a* widths), W' and W", and opposing pivot lengths (or opposing pivot link, 26*a*/26*d*, 26*b*/26*c* lengths), L' and L" that form the functional four bar linkage for purposes of pivotably mounting/supporting the foot pedal 24*a* from an upper portion 18*d* (or foot pedal 24*b* from upper portion 18*c*) of the overhead support arm or leg, 16*b*, 16*c*, of the frame. The foot pedals 24*a*, 24*b* themselves comprise a structural portion or the whole of the lower pivot link of the four bar linkages in the embodiments shown in FIGS. 1-10. The distances between the width pivot points 31*a* and 31*d*, W' and between the width pivot points 31*e* and 31*f*, W" are preferably equal or substantially equal. And, the distances between the length pivot points 31*d* and 31*e*, L' and between the length pivot points 31*a* and 31*f*, L" are also preferably equal or substantially equal such that the difference between angles A1 and A2, i.e. the degree of rotation or pivot of the foot pedal 24*a* from back to front and front to back along the arcuate path of translation of the foot pedal from front to back and vice versa is less than about 3 degrees, typically less than about 2.5 degrees. The foot pedals have a foot sole receiving upper surface that defines a generally planar orientation or plane in which the sole of the foot of the user is maintained when standing on a foot pedal. Angle A1 is the angle between the foot sole orientation plane PP1 in which the foot sole surface resides at the forwardmost end of the front to back path of translation and a fixed selected reference plane RP. Angle A2 is the angle between the sole orientation plane PP2 in which the foot sole surface resides at the backwardmost end of the front to back path of translation and the fixed selected reference plane RP. In this preferred embodiment, the difference between angles A1 and A2, at any point/position along the back to front/front to back path of translation of the food pedal 26*a* is preferably less than about 3 degrees (typically less than about 2.5 degrees), i.e. the plane in which the foot sole surface of the pedal 24*a* resides does not rotate or pivot more than about 3 degrees at any time during movement through the arcuate path of translation.

As can be readily seen from FIGS. 1-10, the foot pedals always travel in the same arcuate or other configuration of path of travel from front to rear and from rear to front. The overall arcuate path of travel J, FIG. 7, that the pedals 24 *a, b* may travel in remains the same regardless of what degree of pivot the arm 38 is positioned in. Pivoting the support arm 38 to different pivot positions only changes the arc "segment" (e.g. segment AP, FIG. 7, or segment AP', FIG. 8, or segment AP", FIG. 10) through which the pedals may travel from rearwardmost to forwardmost positions but does not change the overall path of arcuate travel J. The overall arcuate path of travel J is defined by the machine or apparatus itself, i.e. by the mounting, positioning, lengths and widths of the links 18*c, d*, 24*a, b* and 26*a-d*. The user may select a segment of the overall machine defined arcuate path of foot pedal travel J depending on the degree of pivoting of arm 38 that the user selects for any given exercise session. As described below each segment selected will have a different degree of incline, e.g. H1 for segment AP and H2 for segment AP'.

Figure 7:
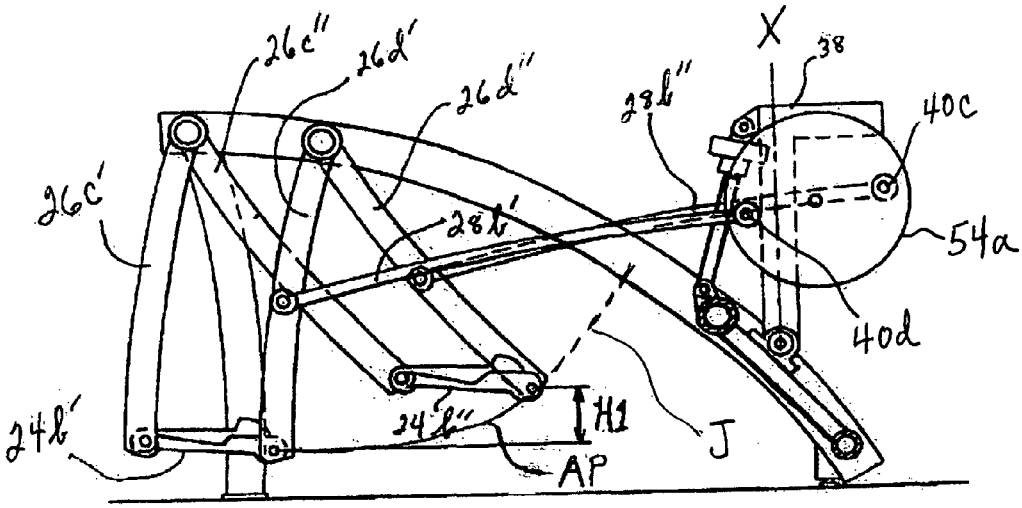
FIG. 7 is a right side view of the FIG. 5A and/or the FIGS. 1-6 embodiment showing the foot pedal 24*b* and link or bar 28*b* in their forwardmost and rearwardmost positions when the mounting member 38 for the flywheel and brake assembly, crank arms 40*a*, 40*b* and other associated components is positioned in a more backwardly pivoted position where axis X of mounting member 38 is in a nearly vertical orientation.
Figure 8:
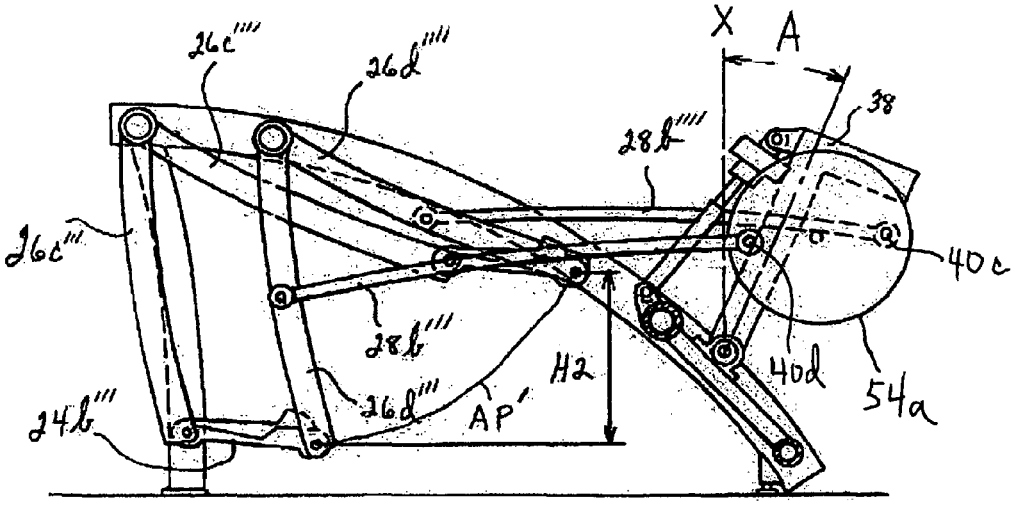
FIG. 8 is a right side view of the FIG. 5A and/or the FIGS. 1-6 embodiment showing the foot pedal 24*b* and linkage bar 28*b* in their forwardmost and rearwardmost positions when the mounting member 38 for the flywheel and brake assembly, crank arms 40*a*, 40*b* and other associated components is positioned in a more forwardly pivoted position where axis X of mounting member 38 is pivoted an angle A forwardly of the position shown in FIG. 7.

FIGS. 7 and 8 more clearly illustrate the previously described selectability of the arc segment when the mounting member 38 and its associated control components 30 such as flywheel 54*a*, brake and crank elements is/are pivoted or tilted from one orientation to another. As shown in FIG. 7, the pivotable mounting member 38 is positioned with its longitudinal axis X arranged in about a vertical orientation. In this orientation, the maximum difference in height or incline H1 between the rearwardmost position 24 *b'* of the foot pedal 24*b* and forwardmost position 24*b"* of the foot pedal 24*b* is less than the maximum difference in height or incline H2 of FIG. 8 where the axis of the mounting member 38 and its associated components 30 have been tilted or pivoted forwardly by an angle A from the position of FIG. 7. As shown, the arcuate path AP of the pedals 24*b* in FIG. 7, going from position 24*b'* to 24*b"*, is less steep or upwardly inclined than the arcuate path AP' of the pedals going from position 24*b'"* to 24*b'"* in FIG. 8. Thus, as shown, the user can select the degree of arc of travel of the pedals by selecting the position of tilt of assembly 30 to which the linkage bars 28*b* are attached.

As also shown in FIGS. 7 and 8 the pedals travel along the same path AP or AP' from front to rear and from rear to front.

Figure 9:
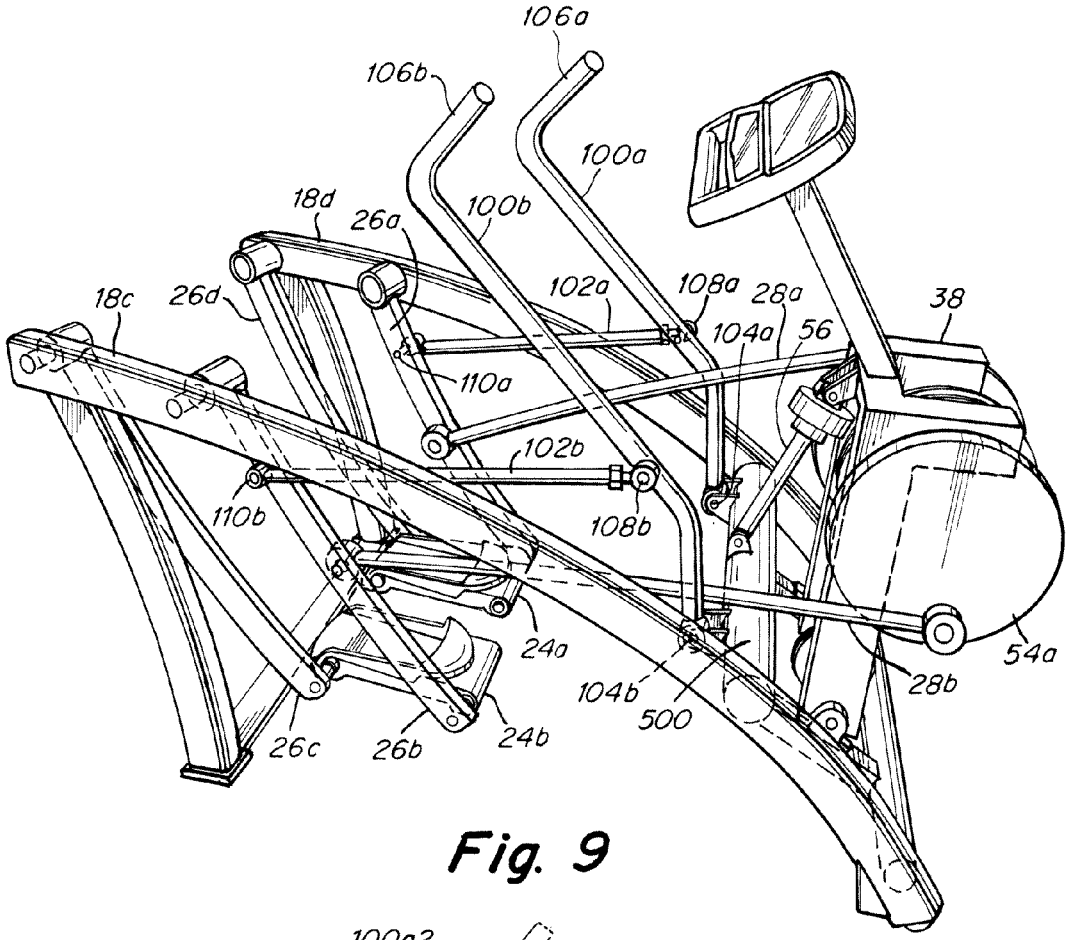
FIG. 9 is a right side perspective view of the FIGS. 1-8 apparati having a pair of pivotable handles pivotably attached to the forward four bar linkage legs 26*a*, 26*b* and to the frame via a support bar 500.
Figure 10:
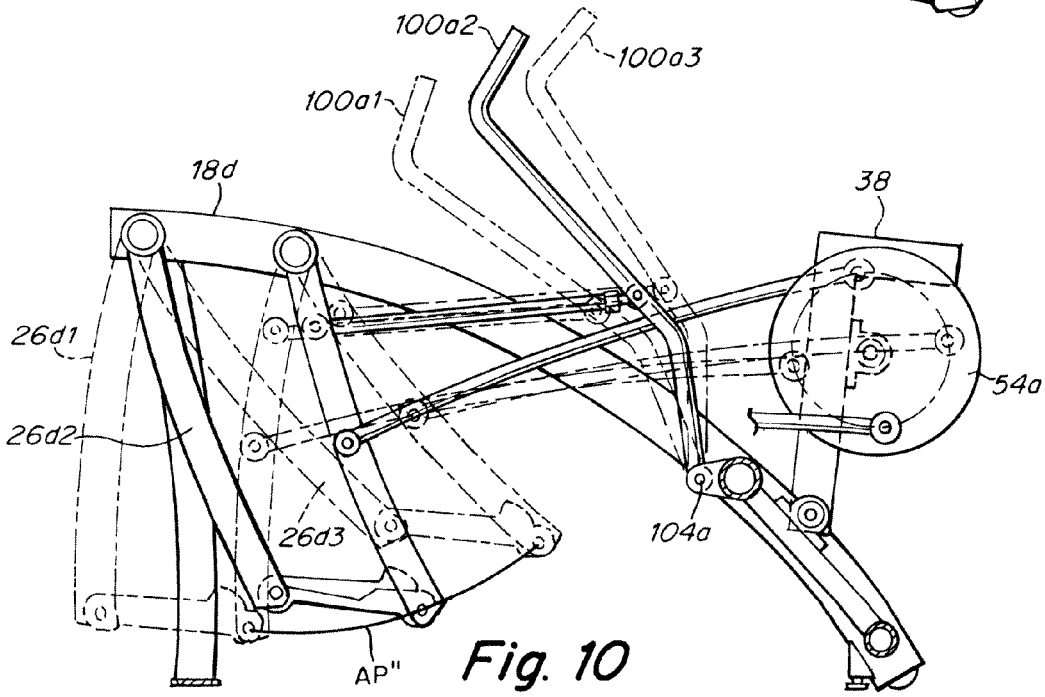
FIG. 10 is a right side view of the FIG. 9 apparatus.

FIGS. 9 and 10 show an embodiment where a pair of pivoting upper body input arms 100*a*, 100*b* are provided that the user can manually grasp by hand at an upper region such as handles 106*a*, 106*b*, the handles 106*a, b* being a rigidly connected extension of arms 100*a*, 100*b* respectively and moving/pivoting together with the arms forward or backward. The handles 106*a*, 106*b* and arms 100*a*, 100*b* are pivotably interconnected to both the frame and to the pedals. As shown the handles 106*a*, 106*b* and arms 100*a*, 100*b* are pivotably interconnected to the frame via a cross bar member 500, the bottom ends of the arms being freely pivotably mounted via pin/aperture joints 104*a*, 104*b* at their bottom ends, the joints being attached to bar support member 500 at appropriate distances from each other along the length of bar support 500. Arm linkage members 102*a*, 102*b*, are pivotably attached at one end to the arms at joints 108*a*, 108*b* which allow the linkage members to rotate/pivot on and with respect to the arms. Linkage members 102*a*, 102*b* are also pivotably attached at another end to some component of the arcuate path traveling assembly of foot pedal, and four bar linkage supports 26. As shown in FIGS. 9, 10 an end of the linkages 102*a*, 102*b* distal from the arm connection point are pivotably attached to the forward longitudinal four bar linkage members 26*d*, 26*a* respectively via joints 110*a*, 110*b* that allow the linkage members to rotate around the axes of the joints, the joints interconnecting the linkage members 102*a, b* and the longitudinal four bar linkage members 26*d, a*.

As shown in FIG. 10, as the foot pedal assemblies 24, 26 travel along the arcuate path AP" from either front to back or from back to front, the handles 106 and arms 100 follow the front to back movement of the pedals with a pivoting front to back or back to front movement. That is, when the right pedal 24*a* moves forwardly the right handle 106*a* and arm 100*a* pivot or move forwardly; when the right pedal 24*a* moves-backwardly the right handle 106*a* and arm 100*a* pivot or move rearwardly; when the left pedal 24*b* moves forwardly the handle 106*b* and arm 100*b* pivot or move forwardly; when the left pedal 24*b* moves rearwardly the handle 106*b* and arm 100*b* pivot or move rearwardly. Such following motion is shown for example with reference to four bar linkage arm 26*d* in three sequential front to back positions 26*d*1, *d*2 and *d*3 which correspond respectively to arm 100*a* positions, 100*a*1, *a*2, *a*3. The degree of front to back pivoting of the arms 100*a, b* can be predetermined at least by selective positioning of the pivot joints 108*a*, 108*b*, 110*a*, 110*b*, selective positioning of cross bar 500 and selection of the lengths of linkage arms 102*a*, 102*b*.

In the FIGS. 9, 10 embodiments, the user can reduce or transfer the amount of energy or power required by the user's legs and/or feet to cause the foot pedals to travel along the arcuate path AP" from back to front by pushing forwardly on the upper end of the arms 102*a*, 102*b* during the back to front pedal movement. And, the user can increase the speed of forward movement by such pushing; or reduce the speed and increase the power or energy required by the legs to effect forward movement by pulling. Conversely the user can reduce or transfer the amount of power or energy required to cause the pedals to move from front to back by pulling backwardly on the upper end of the arms. And, the user can increase the speed of rearward movement by such pulling or reduce the speed by pushing; or reduce the speed and increase the power or energy required by the legs to effect rearward movement by pushing.

The four bar linkage foot assemblies, 24*a*, 26*a, d*, 18*d* and 24*b*, 26*c, b*, 18*c* that are pivotably linked via the linkages 102*a*, 102*b* to the pivotably mounted arms 100*a, b* can be configured to enable the foot pedal and the plane in which the sole of the foot is mounted to either not rotate or to rotate/pivot to any desired degree during front to back movement by selecting the lengths L' and L" and widths W and W', FIG. 5A appropriately to cause the desired degree of rotation/pivoting. These four bar linkage assemblies also, via the above described linkages to the arms 100*a, b*, cause the arms to travel along the same path of pivot from front to back and back to front.

In the embodiment shown in FIGS. 1-5 and 5*a*, 7-10, the linkages 28*a, a', a", a'"* and 28*b, b', b", b'"* are interconnected to the flywheel 54*a* via the four bar linkage and the linkages

28*a*, 28*b* at opposing 180 degree circle positions 40*c* and 40*d* from the center of rotation 54*b* of the crank arms 40*a, b* and/or flywheel 54*a*, i.e. the linkages are connected at maximum forward and maximum rearward drive positions respectively. This 180 degree opposing interconnection causes the right 24*b, b', b'', b'''* and left 24*a* foot pedals to always travel in opposite back and forth translational directions, i.e. when the right pedal is traveling forward the left pedal is traveling backwards and vice versa. Similarly, the pivotably mounted arms 100*a* and 100*b* are interconnected to the flywheel 54*a* via the four bar linkage, the links 28*a*, 28*b* and the links 102*a*, 102*b* such that when the right arm is moving forward the left arm is moving backward and vice versa. As shown in FIGS. 9, 10 the arms 100*a*, 100*b* travel forwardly or backwardly together with their associated foot pedals 28*a* and 28*b* respectively.

In any event, the left and right side pedals 24*a, b* and input arms 100*a, b* are linked to the resistance or drive assembly (in the embodiments shown, the flywheel and associated crank arms) such that when the left side components (i.e. left pedal and associated input arm) are traveling forward the right side components (i.e. right pedal associated input arm) are traveling backward for at least the majority of the travel path and vice versa.

The upper body input arms 100*a, b* are interconnected or interlinked to the same pivotable mounting member 38 as described above via the links 102*a, b*, four bar linkage members 26*a, b* and links 28*a, b* as shown in FIGS. 9, 10. In the same manner as forward or backward pivoting of the mounting member 38 changes the degree of incline and/or path of travel of foot pedals 24*a, b* as described above with reference to FIGS. 7, 8, a forward or backward pivoting of the mounting member 38 also changes the degree of back to front pivoting and/or the degree of path of travel of arms 100*a, b*. Thus, in the same manner as the user is able to select the degree of incline of the path of travel of the foot pedals, e.g. arc path AP versus arc path AP' as shown in FIGS. 7, 8 and also described above with regard to mount member 38 enabling the user to select the degree of arc segment stride length and angle/incline, the user is able to select the degree of back to front/front to back pivot stroke or travel path of input arms, 100*a, b*; by adjusting the front to back pivot position of the center of rotation of rotation connection/interconnection points 40*c* and 40*d*.

The input arms 100*a, b* are linked to the foot pedals 24*a, b* in a manner that causes an input arm (e.g. 100*a*) to move forwardly as its associated foot pedal (24*a*) moves forwardly and upwardly, or conversely that causes an input arm to move backwardly as its associated foot pedal moves backwardly and downwardly along the user selected arc segment.

The invention claimed is:

1. An apparatus for simulating a back and forth leg or foot movement comprising:

a pair of left and right foot pedals each having a foot sole receiving surface horizontally oriented relative to the ground for a user standing thereon vertically upright, the foot pedals being mounted on a frame for movement in a back and forth direction along an arcuate path between forwardmost upward horizontal and rearwardmost downward horizontal positions;

a pair of left and right manually graspable input arms each pivotably interconnected to a respective one of the left and right foot pedals such that the left arm pivots forwardly together with forward and upward movement of the left pedal, the left arm pivots rearwardly together with backward and downward movement of the left pedal, the right arm pivots forwardly together with forward and upward movement of the right pedal and the right arm pivots rearwardly together with backward and downward movement of the right pedal.

2. The apparatus of claim 1 wherein the foot pedals are adjustable to move in an arcuate path of selected incline.

3. The apparatus of claim 1 wherein the input arms are adjustable to move in a pivot path of selected degree of pivot.

4. The apparatus of claim 1 wherein the pedals and the input arms are interconnected to a pivot mechanism adjustable to a selected degree of pivot that adjusts the arcuate path of the foot pedals and the degree of pivot of the input arms.

5. The apparatus of claim 1 wherein the arms and the pedals are interconnected to a reciprocating mechanism that directs one of the left or right pedals to travel in the back or forth direction while simultaneously directing the other of the left or right pedals to travel in an opposite direction.

6. The apparatus of claim 1 wherein the arms and the pedals are interconnected to a reciprocating mechanism that directs one of the left or right pedals to travel in the back or forth direction while simultaneously directing the other of the left or right pedals to substantially always travel in an opposite direction.

7. The apparatus of claim 5 wherein the reciprocating mechanism comprises a rotating mechanism having a pair of pivot points, one pivot point pivotably interconnected to one of the left or right pedals and arms and the other pivot point pivotably interconnected to the other of the left or right pedals and arms.

8. The apparatus of claim 5 wherein the pivot points are disposed at substantially opposing 180 degree positions along a circular path of rotation, the pedals and the arms being interconnected to a respective pivot point by a link mechanism.

9. The apparatus of claim 1 wherein the foot pedals pivot or rotate less than about three degrees during movement between the forwardmost and backwardmost positions.

10. The apparatus of claim 1 wherein each of the foot pedals are mounted on the frame via a four bar linkage mechanism.

11. An apparatus for simulating a back and forth leg or foot movement of a user comprising:

a pair of left and right foot pedals each having a foot sole receiving surface horizontally oriented relative to the ground, the foot pedals being mounted and arranged on a frame by linkages for supporting the user vertically upright and for movement in a back and forth direction along an overall arcuate path defined by the linkages;

a pair of left and right manually graspable input arms each pivotably interconnected to a respective one of the left and right foot pedals for pivoting movement in the back or forth direction;

wherein the foot pedals are adjustable to move along a selected segment of the overall arcuate path between forwardmost upward horizontal and backwardmost downward horizontal positions, the selected segment of the overall arcuate path being variably selectable by the user to have a variable degree of incline;

wherein the left arm pivots forwardly together with forward movement of the left pedal, the left arm pivots rearwardly together with backward movement of the left pedal, the right arm pivots forwardly together with forward movement of the right pedal and the right arm pivots rearwardly together with backward movement of the right pedal.

12. The apparatus of claim 11 wherein the foot sole receiving surfaces pivot or rotate less than about three degrees between the forwardmost and backwardmost positions.

13. The apparatus of claim 11 wherein the linkages comprise a four bar linkage mechanism.

14. An apparatus for simulating a back and forth leg or foot movement of a user comprising a pair of left and right foot pedals each having a foot sole receiving surface horizontally oriented relative to the ground, the foot pedals being mounted and arranged on a frame for supporting the user standing thereon vertically upright and for movement in a back and forth direction along any one of a plurality of reproducible user selectable segments of an arcuate path between forwardmost upright horizontal and rearwardmost downward horizontal positions;

a pair of left and right handles for being grasped by a user's hands each pivotably interconnected to a respective one of the left and right foot pedals such the left handle pivots forwardly together with forward movement of the left pedal, the left handle pivots backwardly together with backward movement of the left pedal, the right handle pivots forwardly together with forward movement of the right pedal and the right handle pivots backwardly together with backward movement of the right pedal.

* * * * *